United States Patent [19]

Sato et al.

[11] 4,233,355

[45] Nov. 11, 1980

[54] SEPARABLE COMPOSITE FIBER AND PROCESS FOR PRODUCING SAME

[75] Inventors: Yoshiaki Sato; Hajime Arai, both of Mishima, Japan

[73] Assignee: Toray Industries, Inc., Tokyo, Japan

[21] Appl. No.: 17,949

[22] Filed: Mar. 6, 1979

[30] Foreign Application Priority Data

Mar. 9, 1978 [JP] Japan ..... 53/26981
Sep. 14, 1978 [JP] Japan ..... 53/112379

[51] Int. Cl.[3] ..... D03D 15/00

[52] U.S. Cl. ..... 428/224; 264/171; 428/253; 428/364; 428/365; 428/374; 428/397; 528/293

[58] Field of Search ..... 264/147, 171; 428/224, 428/373, 374, 397, 365, 364, 253; 528/293

[56] References Cited

U.S. PATENT DOCUMENTS

| | | | |
|---|---|---|---|
| 3,017,686 | 1/1962 | Breen et al. | 428/373 |
| 3,117,362 | 1/1964 | Breen | 428/373 |
| 3,671,379 | 6/1972 | Evans et al. | 428/373 |
| 3,700,545 | 10/1972 | Matsui et al. | 428/374 |
| 3,958,066 | 5/1976 | Imamura et al. | 428/373 |

*Primary Examiner*—James J. Bell
*Attorney, Agent, or Firm*—Miller & Prestia

[57] ABSTRACT

A separable unitary composite fiber of the type having a substantially uniformly shaped transverse cross-section along its length and comprised of at least two different polymer components, one of which is soluble in a given solvent and the other of which is relatively insoluble in the given solvent; a plurality of segments of the relatively insoluble polymer component being isolated from each other by the intervening soluble polymer component in the transverse cross-section of the composite fiber. The composite fiber is characterized in that the soluble polymer component is a polyester comprised of 80 to 97% by mole of ethylene terephthalate units and 3 to 20% by mole of ethylene 5-sodium-sulfoisophthalate units, and the relatively insoluble polymer component is a fiber-forming polyester and/or polyamide.

12 Claims, 14 Drawing Figures

SEPARABLE COMPOSITE FIBER AND PROCESS FOR PRODUCING SAME

BACKGROUND OF THE INVENTION

1. Field of the Invention

This invention relates to a separable unitary composite fiber comprised of at least two different polymer components, one of which is soluble in a given solvent and the other of which is relatively insoluble in the given solvent, a plurality of segments of the relatively insoluble polymer component being isolated from each other by the intervening soluble polymer component in the transverse cross-section of the composite fiber. It relates further to a process for producing such a separable unitary composite fiber.

2. Description of the Prior Art

It is widely known that a separable unitary composite fiber comprised of a soluble polymer component and a relatively insoluble polymer component, and having a transverse cross-section such that a plurality of segments of the relatively insoluble polymer component are isolated from each other by the intervening soluble polymer component, can be divided into a plurality of fine, separate independent fibers by subjecting the unitary composite fiber to the action of a solvent capable of dissolving the soluble polymer component. By the term "relatively insoluble" used herein is meant that the polymer component is insoluble or only slightly soluble in a given solvent. The fine, separate independent fibers can be of an extremely small fineness, e.g. below one denier, and can constitute a woven or knitted fabric having a silk-like hand. The process of obtaining such a fabric from a separable unitary composite fiber resembles that of obtaining a silk fabric from a raw silk, i.e., a fibroin-sericin composite fiber, by dissolving out sericin from the composite fiber.

The following requisites are generally needed or desired for obtaining fine fibers from a separable unitary composite fiber.

(1) The difference in the rate of dissolution between the soluble polymer component and the relatively insoluble polymer component is large, and the rate of dissolution of the soluble polymer component is rapid.

(2) The apparatus and operation employed are not complicated, and the solvent used is not corrosive to the apparatus and is satisfactory from standpoints of cost and safety.

(3) The soluble polymer component is readily available and not costly.

(4) The soluble polymer component and the relatively insoluble polymer component are not liable to be undesirably separated from each other during the processes of spinning, drawing and weaving or knitting, conducted before the composite fiber is subjected to the action of a solvent.

It has been heretofore proposed in Japanese Patent Publication No. 42,847/1972 and Japanese Laid-open Patent Application No. 9,021/1973 that, for the purpose of producing polyester fibers characterized as possessing enhanced melting point, strength, modulus of elasticity and resistance to chemicals, and having good electrical properties, polystyrene and nylon-6 be used as the soluble polymer component of a separable unitary composite fiber. Polystyrene and nylon-6 are, however, not advantageous in that a solvent, which is expensive and not safe, such as a special organic solvent or a strong acid, is necessary for the dissolution of these soluble polymer components. Furthermore, nylon-6 is liable to be separated from the relatively insoluble polymer component prior to the step of dissolving nylon-6.

Another proposal has been made in which a composite fiber comprised of a relatively insoluble polyester and a soluble polyester readily compatible with the relatively insoluble polyester is subjected to the action of an aqueous alkaline solution. For example, U.S. Pat. No. 3,117,362 discloses a combination of polyethylene terephthalate as the relatively insoluble polyester with a copolymer comprised of polyethylene terephthalate and poly(ethylene oxide) glycol as the soluble polyester. However, the copolymer used as the soluble polyester must contain a large porportion of the units derived from poly(ethylene oxide) glycol, so that the copolymer will be readily dissolved in a given solvent. This copolymer which contains a large proportion of poly(ethylene oxide) glycol units is, however, poor in spinnability. Furthermore, Japanese Patent Publication Nos. 47,532/1972 and ibid. 47,533/1972 disclose a combination of polyethylene terephthalate as the relatively insoluble polyester with a polyethylene terephthalate composition, as the soluble polyester, having incorporated therein an additive such as a special polyalkylene glycol or an anionic surface active agent. The composite fibers disclosed in these two publications are still not advantageous in that the incorporated additive is difficult to distribute uniformly along the length of the fibers and, thus, the division of the composite fiber cannot be uniformly and smoothly effected. Furthermore, Japanese Patent Publication No. 33,415/1973 refers to the use, as the soluble polyester, of an alkali-soluble copolyester (containing polyethylene glycol or polypropylene glycol), a blend thereof, polyethylene sebacate, polyethylene adipate, a copolymer of di- or triethylene glycol terephthalate or polyethylene terephthalate, or a copolyester containing polyethylene glycol/polypropylene glycol units. These soluble polyesters are generally difficult to melt-spin stably over a long period of time, or the resulting composite fibers cannot be uniformly and smoothly divided.

Still another proposal has been made in which a composite fiber comprised of a relatively insoluble polyamide and a soluble polyester is subjected to the action of a given solvent, thereby to dissolve out the soluble polyester from the composite fiber and to obtain polyamide fibers characterized as possessing enhanced melting point, strength, abrasion resistance and chemical resistance, and having good electrical properties. For example, Japanese Patent Publication No. 28,005/1973 discloses a separable unitary composite fiber comprised of a polyester component and a polyamide component. It is referred to in this reference that the polyester component may be removed from the composite fiber by using an aqueous alkaline solution. However, it is actually difficult to dissolve out the polyester component disclosed in this reference. Moreover, the polyester component and the polyamide component are liable to be separated from each other during the drawing process, which separation leads to fluff formation and yarn break during the weaving or knitting process.

U.S. Pat. No. 3,117,362 discloses a separable composite fiber comprised of four segments of polyhexamethylene adipamide separated by the intervening polyethylene terephthalate. This polyhexamethylene adipamide-polyethylene terephthalate composite fiber is also liable to be separated into the respective polymer components during the drawing process, and fluff formation and yarn break cannot be avoided.

SUMMARY OF THE INVENTION

An object of the present invention is to provide a separable unitary composite fiber comprised of at least two polymer components, one of which is soluble in a given solvent and the other of which is relatively insoluble in the given solvent, these at least two polymer components not being liable to be separated in the drawing process and the weaving or knitting process.

Another object of the present invention is to provide a separable unitary composite fiber comprised of at least two polymer components, one of which is soluble in a given solvent and the other of which is relatively insoluble in the given solvent, the soluble polymer component being capable of being readily and almost completely dissolved in an aqueous dilute alkaline solution without any significant dissolution of the relatively insoluble polymer component, and which composite fiber can be separated into fine fibers exhibiting good uniformity along their lengths.

Other objects and advantages of the present invention will be apparent from the following description.

In accordance with the present invention, there is provided a separable unitary composite fiber having a substantially uniformly shaped transverse cross-section along its length, the composite fiber being comprised of at least two polymer components, one of which is soluble in a given solvent and the other of which is relatively insoluble in the given solvent, a plurality of segments of the relatively insoluble polymer component being isolated from each other by the intervening soluble polymer component in the transverse cross-section of the composite fiber, the composite fiber being characterized in that the soluble polymer component is a polyester comprised of 80 to 97% by mole of ethylene terephthalate units and 3 to 20% by mole of ethylene 5-sodium-sulfoisophthalate units and the relatively insoluble polymer component having a fiber-forming polyester or polyamide.

BRIEF DESCRIPTION OF THE DRAWINGS

The features of the present invention will be better understood from the following detailed description taken in conjunction with the accompanying drawings, in which.

DESCRIPTION OF THE PREFERRED EMBODIMENTS

Referring to FIGS. 1*a* through 1*f*, which are transverse cross-sectional views of various separable unitary composite fibers having substantially uniformly shaped transverse cross-sections along their lengths, and to FIGS. 2*a* through 2*f* which are transverse cross-sectional views of the separated fibers obtained from the composite fibers illustrated in FIGS. 1*a* through 1*f*, references A and B indicate a polymer component soluble in a given solvent and a polymer component relatively insoluble in the given solvent, respectively.

Figure 1A:
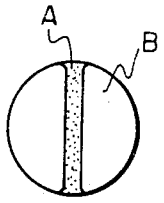
FIGS. 1*a* through 1*f* are transverse cross-sectional views of examples of various separable unitary composite fibers embodying the present invention.
Figure 1B:
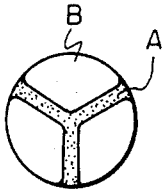
Figure 1C:
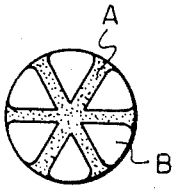
Figure 1D:
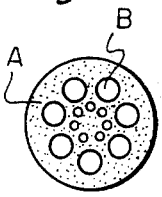
Figure 1E:
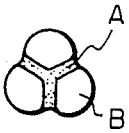
Figure 1F:
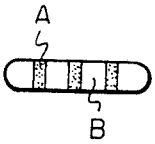
Figure 2A:
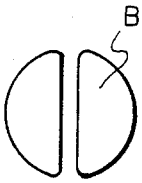
FIGS. 2*a* through 2*f* are transverse cross-sectional views of the separated fibers obtained from the separable unitary composite fibers illustrated in FIGS. 1*a* through 1*f*, respectively.
Figure 2B:
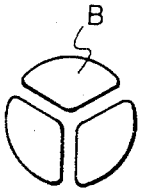
Figure 2C:
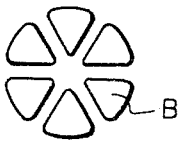
Figure 2D:
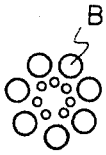
Figure 2E:
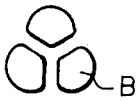
Figure 2F:
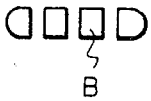

In FIGS. 1*a*, 1*b* and 1*c*, two, three and six segments, respectively, of a relatively insoluble polymer component B are isolated from each other by an intervening soluble polymer component A in the transverse round cross-section of each composite fiber. When the respective composite fibers are subjected to the action of an aqueous alkaline solution, the soluble polymer components A are dissolved out from the composite fibers to obtain separate independent fibers having a transverse cross-section as illustrated in FIGS. 1*a*, 1*b* and 1*c*. In FIG. 1*d*, an islands-in-a-sea type separable unitary composite fiber is illustrated, wherein fourteen islands of a relatively insoluble polymer component B are isolated from each other by a sea component, i.e., an intervening soluble polymer component A. This islands-in-a-sea type composite fiber can be, by the treatment of an aqueous alkaline solution, separated into fourteen independent fibers, illustrated in FIGS. 2*d*, which are comprised of two types of fibers, one type being finer than the other. In FIGS. 1*e* and 1*f*, separable unitary composite fibers of special profile cross-sections, i.e., different from round cross-sections illustrated in FIGS. 1*a*, 1*b*, 1*c* and 1*d*, are illustrated, wherein three and four segments, respectively, of a relatively insoluble polymer component B are isolated from each other by an intervening soluble polymer component A. These profile cross-sectional composite fibers can be, by the treatment of an aqueous alkaline solution, separated into three and four independent fibers, respectively, as illustrated in FIGS. 2*e* and 2*f*.

The main feature of the present invention resides in the fact that the soluble polymer component intervening between a plurality of segments of the relatively insoluble polymer component is a polyester comprised of 80 to 97% by mole of ethylene terephthalate units and 3 to 20% by mole of ethylene 5-sodium-sulfoisophthalate units.

The percentage of weight reduction of the composite fiber varies greatly depending upon the content of ethylene 5-sodium-sulfoisohthalate units in the soluble polymer component. By the term "percentage of weight reduction", used herein, is meant that defined by the following equation.

$$\% \text{ weight reduction} = [(A-B)/A] \times 100$$

where A is the weight of the fiber or polymer as measured before the aqueous alkaline solution treatment and B is the weight of the fiber or polymer as measured after the aqueous alkaline solution treatment. The above-mentioned fact will be apparent from the following experiments.

Copolyesters, each comprised of ethylene terephthalate units and ethylene 5-sodium-sulfoisophthalate units, were treated at a temperature of 100° C. for a period of twenty minutes with an aqueous alkaline solution containing 20 grams of sodium hydroxide/liter. The percentage of weight reduction was as indicated in Table I, below.

TABLE I

| Content of ethylene 5-Na-sulfoisophthalate in copolymer (mole %) | Weight reduction of copolymer (%) |
|---|---|
| 0 | 1.9 |
| 2 | 5.6 |
| 3 | 22 |
| 4 | 40 |
| 5 | 58 |
| 7 | 79 |
| 9 | 95 |

As can be seen from Table I, the greater the content of ethylene 5-sodium-sulfoisophthalate in the copolymer, the greater the percentage of weight reduction. It is surprising that the gradient of the percent of weight reduction abruptly increases at the 5-sodium-sulfoisophthalate content of approximately 3% by mole.

Composite fibers, each of which was comprised of 75% by weight of polyethylene terephthalate and 25% by weight of an ethylene terephthalate/ethylene 5-sodium-sulfoisophthalate copolymer, and had a transverse cross-section such that three segments of the polyethylene terephthalate were separated from each other by the intervening copolymer, as illustrated in FIG. 1*b*, were treated with an aqueous alkaline solution, in a manner similar to that mentioned above with respect to the ethylene terephthalate/ethylene 5-sodium-sulfoisophthalate copolymer, until the three segments of the polyethylene terephthalate were completely separated into independent fibers. The percentage of weight reduction was as indicated in Table II, below.

TABLE II

| Content of ethylene 5-Na-sulfoisophthalate copolymer (mole %) | Weight reduction of fiber (%) |
|---|---|
| 2 | 43 |
| 3 | 29 |
| 4 | 27 |
| 5 | 26.0 |
| 7 | 25.5 |
| 9 | 25.2 |

It is desirable that a plurality of segments of the relatively insoluble polymer component be completely separated into dependent fibers when the percentage of weight reduction of fiber reaches approximately the same value as the percentage of content (e.g. 25% in the above-mentioned experiments) of the soluble ethylene terephthalate/ethylene 5-sodium-sulfoisophthalate copolymer in the composite fiber. If the separation of the segments of the relatively insoluble polymer component is not completed until the percentage of weight reduction of fiber exceeds the percentage of content of the soluble copolyester in the composite fiber, the following disadvantages are brought about. First, the relatively insoluble polymer component is partially dissolved out from the composite fiber, and hence, the resulting separated fibers become poor in mechanical strength. Secondly, a substantially long period is required for the aqueous alkaline solution treatment. Thirdly, in the case where composite fibers in the woven or knitted fabric form are threated with an aqueous alkaline solution, the resulting woven or knitted fabric has a low density, and is loose and liable to be readily distorted by an external force. The experimental data indicated in Table II show that, when the content of ethylene 5-sodium-sulfoisophthalate units in the copolyester is less than approximately 3% by mole, the separation of the segments of the relatively insoluble polymer component is completed at an extra-ordinarily enhanced weight reduction of fiber. Thus, the content of ethylene 5-sodium-sulfoisophthalate its in the copolyester should be at least 3% by mole.

The reason the ethylene 5-sodium-sulfoisophthalate/ethylene terephthalate copolymer is readily dissolved out by an aqueous alkaline solution can not be clearly elucidated. However, it is observed that, when the composite fiber is treated with an aqueous alkaline solution, extremely fine fibers float in the treating liquid, and accordingly, it is presumed that the above-mentioned copolymer is readily subject to fibrillation.

The composite fiber of the present invention is not liable to be separated into the respective polymer components during the drawing and weaving or knitting process, and fluff formation and yarn break occur only to a negligible extent during the weaving or knitting process.

In general conventional composite fibers, especially comprised of polyester and polyamide, are liable to be subject to fluff formation or yarn break in the weaving or knitting process. Particularly, in the case where the composite fibers are woven as warp, the fibers are repeatedly brought into frictional contact with reeds and healds in a weaving machine, and hence, separated into the respective polymer components, thus leading to fluff formation and yarn break.

It now has been found that the yarn breaks have a close relationship with the separation resistance which is measured by a method mentioned below. In order to suppress the frequency of yarn break to a satisfactorily number, e.g. one time or less per 1,000,000 meters of the warp yarn, the warp yarn should withstand being rubbed at least 2,000 times when the separation resistance of the warp yarn is measured by the below-mentioned method. Preferably, the separation resistance so measured is at least 2,500 times. It has further been found that the fluff formation also has a close relationship with the separation resistance, and the warp yarn should exhibit a separation resistance of at least 1,000 times for suppressing the fluff formation to a practically acceptable extent. The more the content of ethylene 5-sodium-sulfoisophthalate in the soluble copolyester, the greater the separation resistance of fiber. Particularly, when the content of ethylene 5-sodium-sulfoisophthalate exceeds approximately 3% by mole, the separation resistance of fiber is greatly enhanced. Accordingly, the soluble copolyester should contain at least approximately 3% by mole of ethylene 5-sodium-sulfoisophthalate units in this respect.

The soluble copolyester component of the composite fiber of the present invention may contain, in addition to ethylene terephthalate units and ethylene 5-sodium-sulfoisophthalate units, minor proportions of other units, for example, derived from an aliphatic dicarboxylic acid such as adipic acid, sebacic acid or dodecanoic acid; an alicyclic dicarboxylic acid such as 1,4-cyclohexanedicarboxylic acid; an aromatic dicarboxylic acid such as isophthalic acid and 2,6-naphthalenedicarboxylic acid; an aliphatic diol such as butylene glycol and neopentyl glycol; an alicyclic diol such as 1,4-cyclohexanedimethanol; an aromatic diol such as xylylene glycol and 2,2-bis($\beta$-hydroxyethoxyphenyl)propane; a hydroxycarboxylic acid such as 4-$\beta$-hydroxyethoxybenzoic acid; and polyoxyalkylene glycol such as polyethylene glycol. The amount of these compounds should preferably be up to 10% by mole, particularly up to 5% by mole. Furthermore, the soluble copolyester component may contain units derived from a compound having at least three ester-forming functional groups such as trimellitic acid and trimethylolpropane in a proportion such that this compound exhibits no deleterious effects on the soluble copolyester component.

The relatively insoluble polymer component of the composite fiber of the invention is a fiber-forming polyester or polyamide. The fiber-forming polyesters used may be conventional and include, for example, those which are prepared by the condensation of aromatic dicarboxylic acids such as terephthalic acid, isophthalic acid, phthalic acid and naphthalene-2,6-dicarboxylic acid, aliphatic dicarboxylic acids such as adipic acid and sebacic acid, or their esters with diol compounds such as ethylene glycol, diethylene glycol, 1,4-butanediol, neopentyl glycol and cyclohexane-1,4-dimethanol. Of these a polyester comprising at least 80% by mole of ethylene terephthalate units is preferable. The fiber-forming polyester may contain, incorporated therein or in a copolymerized form, a minor proportion of polyalkylene glycol, glycerin, pentaerythritol, methoxypolyalkylene glycol, bisphenol A and sulfoisophthalic acid. Futhermore, the fiber-forming polyester may contain a minor amount of ethylene 5-sodium isophthalate units, although this is not preferable. If ethylene 5-sodium-sulfoisophthalate units are introduced into the fiber-forming polyester, the amount thereof should be less than 4% by mole and at least 4% by mole less than the amount of ethylene 5-sodium-sulfoisophthalate units in the soluble copolyester.

The fiber-forming polyamides used may also be conventional. They include, for example, nylon 6, nylon 10, nylon 11, nylon 12, nylon 66, nylon 610 and copolyamides predominantly comprised of units similar to those of these nylons. Of these, nylon 6 and nylon 66 are preferable.

The fiber-forming polyester and/or polyamide may contain a suitable amount of additives, such as delusterants, antioxidants, fluorescent brighteners, fire-retardants and ultraviolet absorbers.

The separable unitary composite fiber of the invention may be produced by a method wherein at least two polymer components, one of which is soluble in a given solvent and the other of which is relatively insoluble in the given solvent, are spun into a composite fiber having a transverse cross-section such that a plurality of segments of the relatively insoluble polymer component are isolated from each other by the intervening soluble polymer component. In this method, a copolymer comprised of 80 to 97% by mole of ethylene terephthalate units and 3 to 20% by mole of ethylene 5-sodium-sulfoisophthalate units, and a fiber-forming polyester and/or polyamide, must be used as the soluble polymer component and the relatively insoluble polymer component, respectively.

Methods of producing a separable composite fiber having the above-mentioned transverse cross-section are disclosed in, for example, Japanese Patent Publications Nos. 2,485/1972, 33,415/1973 and 29,129/1974. Any known method may be employed for the production of the separable unitary composite fiber of the invention.

As hereinbefore mentioned, the soluble copolymer should contain at least 3% by mole, preferable at least 4% by mole, of ethylene 5-sodium-sulfoisophthalate from a standpoint of its solubility in a given solvent. In general, with an increase in the content of ethylene 5-sodiumsulfoisophthalate in the copolymer, the solubility of the copolymer increases, but the spinning stability and drawability of fiber decreases. Therefore, the content of ethylene 5-sodium-sulfoisophthalate units in the copolymer should be less than 20% by mole, preferably, less than 15% by mole and, more preferably, less than 10% by mole.

The soluble polymer component should preferably possess an intrinsic viscosity (as determined in orthochlorophenol at a temperature of 25° C.) of not greater than 0.60, more preferably, not greater than 0.55. If the intrinsic viscosity of the soluble polymer component exceeds 0.60, an undrawn fiber comprised of the soluble polymer component exhibits a proper drawing ratio less than that of an undrawn fiber comprised of the relatively insoluble polymer component. By the term "proper drawing ratio", used herein, is meant a drawing ratio at which a drawn fiber having an elongation at break of 30% is obtainable. The above-mentioned fact means that, when a composite fiber is drawn at the proper drawing ratio of the soluble polymer component, the relatively insoluble polymer component is not drawn to a satisfactory extent, and consequently, the resulting drawn fiber is poor in mechanical strength.

In the case where the relatively insoluble polymer component is a polyester containing at least 80% by mole of ethylene terephthalate units, it is preferable that the intrinsic viscosity of the polyester be within the range of from 0.50 to 0.80, particularly from 0.55 to 0.75; further, that the intrinsic viscosity thereof is at least 0.05 greater, particularly from 0.10 to 0.25 greater, than the intrinsic viscosity of the soluble polymer component, for the purpose of producing a separable unitary composite fiber or separated independent fibers therefrom, which fiber or fibers have mechanical strengths approximately similar to those of conventional polyester fibers. In the case where the relatively insoluble polymer component is a polyamide, particularly nylon 6, it is preferable that the relative viscosity (as determined in 98% sulfuric acid) of the polyamide be within the range of from 2.0 to 3.5, particularly from 2.2 to 3.2, for the purpose of producing a separable unitary composite fiber or separated independent fibers therefrom, which fiber or fibers have mechanical strengths approximately similar to those of conventional polyamide fibers.

When the segments of the relatively insoluble polymer component in the composite fiber of the invention exhibit, after being drawn, an average fineness of not greater than one denier per segment, the composite fiber results in a woven or knitted fabric which greatly resembles silk or a suede-finished fabric in aesthetics and exhibits enhanced drape, subdued luster and a soft hand. That is, according to a method wherein a fabric is woven or knitted from such drawn composite fibers alone, or a combination of at least two types of such drawn composite fibers, and further, the fabric is treated with an aqueous alkaline solution, a fabric comprised of fine fibers having an average fineness of not greater than one denier per fiber is obtainable. It is generally difficult to produce fine fibers without fluff formation or fiber break occurring during the spinning or drawing step and, also, difficult to weave or knit the fine fibers into a fabric without similar troubles. In contrast, the production of a woven or knitted fabric from the composite fiber is not accompanied by these troubles. A bundle of the composite fibers can be used as warp for weaving without sizing or twisting.

The proportion of the soluble polymer component to the relatively insoluble polymer component in the composite fiber of the invention is preferably in the range of from 40/60 to 2/98, more preferably in the range of from 30/70 to 5/95. The larger this proportion, the easier the division of the composite fiber into separate independent insoluble polymer fibers. However, when the above-mentioned proportion is too large, the spinning stability and drawability of the composite fiber are reduced, thus leading to a reduction in mechanical strength and elongation of the composite fiber.

As a modified form of the composite fiber of the invention, the segments of the relatively insoluble polymer component in the composite fiber can be comprised of at least two different polymers selected from fiber-forming polyesters and/or polyamides. Each segment of the relatively insoluble polymer component can be different from others in fineness. Furthermore, the segments of the relatively insoluble polymer component can be of a side-by-side type composite structure or a sheath-core type composite structure.

The composite fiber of the invention is woven or knitted into fabric in a known manner. The woven or knitted fabric may be utilized as it is. It is, however, preferable that the woven or knitted fabric be treated with an aqueous alkaline solution to dissolve out at least part of the soluble polymer component, whereby a fabric comprised of fine fibers is obtained.

The soluble polymer component does not need to be completely removed from the composite fiber. It is, however, better if the soluble polymer component is removed as completely as possible. If a significant amount of the soluble polymer component remains in the separated fibers, the soluble polymer component tends to cause, after dyeing, non-uniformity in color along the length of the fibers or in the transverse cross-section thereof or to cause discoloration of the fibers.

Although the composite fiber may be alkali-treated prior to weaving or knitting, the composite fiber should preferably be alkali-treated after weaving or knitting. The fabric, so alkali-treated after being woven or knitted, is more bulky and exhibits a softer hand as compared with the fabric woven or knitted from alkali-treated fibers. Furthermore, the efficiency of an alkali-treatment is greater after weaving or knitting than before weaving or knitting. In the case where the fabric is alkali-treated after being woven or knitted, it is preferable that the fabric be, prior to the alkali-treatment, subjected to scouring and, then, a dimensional stabilization treatment under conditions such that no craping defect occurs in the fabric.

The alkali-treatment may be carried out in either a batchwise or continuous manner by using, for example, a jigger, a wince or a beam. An aqueous solution of an alkaline metal hydroxide is used. Among alkaline metal hydroxides, sodium hydroxide is preferable in view of its low cost and enhanced capability for dissolution of the soluble polymer component. The aqueous alkaline metal hydroxide solution is used, preferably, at a concentration of from 1 to 10% by weight and at a temperature of from 70° to 100° C. In order to enhance dissolution of the soluble polymer component, an additive, such as a phenol compound, an amine compound, a quaternary ammonium salt or a high-boiling point polyhydric alcohol, may be incorporated in the aqueous alkaline solution.

Figure 4:
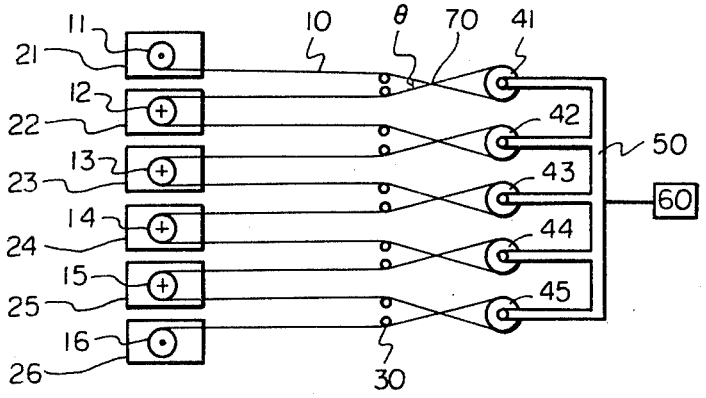
FIG. 4 is a schematic diagram of an apparatus used for measuring resistance to separation of the composite fiber.

The separation resistance of a composite fiber is evaluated by using a frictional cohesion testing apparatus (manufactured by TOYO-SEIKI MFG. CO., Japan). A schematic diagram of this testing apparatus is illustrated in FIG. 4. The testing apparatus comprises vibrational supports 21, 22, 23, 24, 25 and 26 onto which a yarn fixing member 11, rotational guides 12, 13, 14 and 15, and another yarn fixing member 16 are fitted, respectively. The vibrational supports 21, 23 and 25 move concurrently from side to side at an amplitude of 2 centimeters. The other vibrational supports 22, 24 and 26 also moves concurrently from side to side at the same amplitude as that of the supports 21, 23 and 25. The moving direction of the vibrational supports 21, 23 and 25 is exactly opposite to that of the vibrational supports 22, 24 and 26. The testing apparatus further comprises guide rollers 30 and freely rotational grooved rollers 41 through 45. The grooved rollers 41 through 45 are supported on a frame 50 and tensioned by means of weight 60 toward the right in FIG. 4. The weight given is one gram per denier of filament. A filament yarn specimen 10 is passed around the rotational guides 12 through 15, over or under the guide rollers 30 and around the grooved rollers 41 through 45 as illustrated in FIG. 4, and both ends of the yarn are fixed to the respective fixing members 11 and 16. The yarn is twisted twice at each twisting location 70. Each angle $\theta$ is 40 degrees. The vibrational supports are vibrated at a frequency of 100 times per minute, whereby a frictional force is given to the yarn. The separation resistance is expressed by the number of times, measured when the filament yarn specimen is broken or fluff formation is observed. The measurement is made ten times and the average number of strokes is adopted.

The invention will be further illustrated by the following examples.

EXAMPLE 1

Figure 3:
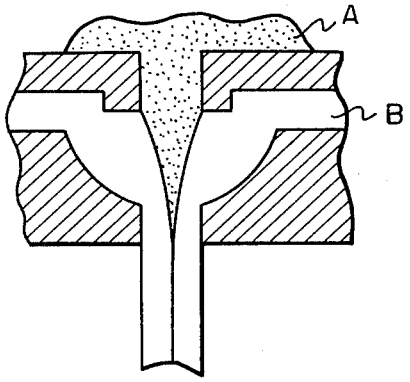
FIG. 3 is a schematic axial cross-sectional view of a spinneret assembly illustrating a state of the separable unitary composite fiber formation.

Polyethylene terephthalate having an intrinsic viscosity of 0.70 and an ethylene 5-sodium-sulfoisophthalate copolymer were melt-spun, by using a composite spinning apparatus as illustrated in FIG. 3 and in Japanese Patent Publication 2,485/1972, at a temperature of 295° C. and a spinning rate of 1,200 meters/minute, to obtain a bundle of 36 composite filaments having a transverse cross-section similar to that shown in FIG. 1*b*. The proportion of ethylene 5-sodium-sulfoisophthalate units in the copolymer and the intrinsic viscosity of the copolymer were as shown in Table III, below. The soluble copolymer occupied 15% by weight of the composite filaments. The bundle of the 36 filaments was drawn in a conventional manner by using a heated pin of 100° C. at a drawing speed of 300 meters/minute, thereby to obtain 36 filaments having a total fineness of 75 deniers. The drawing ratio was as shown in Table III, below. The drawn filaments exhibited an elongation at break of 30%.

The spinning stability and drawability of the filaments were evaluated by the frequency of filament break or filament bundle break. The tensile strength of the drawn filaments was also evaluated. The results are shown in Table III, below.

TABLE III

| Specimen No. | 1 | 2 | 3 | 4 | 5 |
|---|---|---|---|---|---|
| Soluble copolymer composition (mole %)* | 4 | 8 | 12 | 18 | 21 |
| Intrinsic viscosity of | 0.51 | 0.52 | 0.51 | 0.50 | 0.51 |

TABLE III-continued

| Specimen No. | 1 | 2 | 3 | 4 | 5 |
|---|---|---|---|---|---|
| soluble copolymer | | | | | |
| Spinning stability and drawability | Excellent | Excellent | Good | Good | Poor |
| Drawing ratio | 3.3 | 3.2 | 3.0 | 2.9 | 2.7 |
| Tensile strength (g/d) | 4.0 | 3.7 | 3.0 | 2.2 | 1.7 |

Note:
*Soluble copolymer composition is expressed by the content (mole %) of ethylene 5-sodium-sulfoisophthalate units in the soluble copolymer.

It will be apparent from Table III that the spinning stability and drawability and the tensile strength decrease with an increase of the content of ethylene 5-sodium-sulfoisophthalate units in the soluble copolymer. The composite filament specimen No. 5 is difficult to produce and has no practically acceptable tensile strength.

The composite filament specimens No. 1 through 4 were separately woven into fabrics and then, the fabrics were treated with an aqueous sodium hydroxide solution of a concentration of 30 grams/liter, at a temperature of 100° C., for a period of 60 minutes (specimen No. 1), 20 minutes (specimen No. 2), 10 minutes (specimen No. 3) and 4 minutes (specimen No. 4). The resultant fabrics highly resembled silk in aesthetic quality and exhibited good drape and a a soft hand.

EXAMPLE 2

Polyethylene terephthalate having an intrinsic viscosity of 0.68 and an ethylene terephthalate (94% by mole)-/ethylene 5-sodium-sulfoisophthalate (6% by mole) copolymer were melt-spun, by using a composite spinning apparatus similar to that used in Example 1, at a temperature of 295° C. and a spinning rate of 1,100 meters/minute, to obtain a bundle of 16 composite filaments having a transverse cross-section similar to that shown in FIG. 1*c*. The soluble copolymer occupied 20% by weight of the composite filaments. The bundle of the 16 filaments was drawn in a conventional manner by using a heated pin of 100° C. at a drawing speed of 400 meters/minute, thereby to obtain 16 filaments having a total fineness of 50 deniers. The drawn filaments exhibited an elongation at break of 30%. The intrinsic viscosity of the soluble copolymer, the drawing ratio and the tensile strength of the drawn filaments are shown in Table IV, below.

TABLE IV

| Specimen No. | 6 | 7 | 8 | 9 | 10 |
|---|---|---|---|---|---|
| Intrinsic viscosity of soluble copolymer | 0.50 | 0.55 | 0.58 | 0.60 | 0.62 |
| Drawing ratio | 3.3 | 3.1 | 3.0 | 2.9 | 2.8 |
| Tensile strength (g/d) | 4.1 | 3.6 | 2.9 | 2.2 | 1.6 |

As is seen in Table IV, the tensile strength of the drawn filaments decreases with an increase in the intrinsic viscosity of the soluble copolymer. When the intrinsic viscosity exceeds 0.60, the tensile strength of the resulting polyester filaments becomes practically unacceptable.

EXAMPLE 3

Polyethylene terephthalate having an intrinsic viscosity of 0.68 and an ethylene terephthalate (95% by mole)-/ethylene 5-sodium-sulfoisophthalate (5% by mole) copolymer having an intrinsic viscosity of 0.50 were melt-spun, by using a composite spinning apparatus similar to that used in Example 2, at a temperature of 290° C. and a spinning rate of 1,050 meters/minute, to obtain a bundle of 12 composite filaments having a transverse cross-section similar to that shown in FIG. 1*c*. The soluble copolymer occupied 20% by weight of the composite filaments. The bundle of the 12 filaments was drawn in a conventional manner by using a heated pin of 100° C. at a drawing speed of 300 meters/minute and at a drawing ratio of 3.4, thereby to obtain a filament yarn comprised of 12 filaments and having a total fineness of 50 deniers. The filament yarn was woven into a plain fabric (taffeta) with a warp density of 115/2.54 centimeters and a weft density of 115/2.54 centimeters. The plain fabric was scoured in an aqueous bath containing Noigen and sode lime at a temperature of 98° to 100° C., and then, heat-set at a temperature of 180° C., for three minutes, under dry heat conditions such that free shrinkage of the fabric was permitted. Thereafter, the plain fabric was treated with an aqueous solution containing sodium hydroxide at a concentration of 30 grams/liter, at a temperature of 100° C. for a period of 40 minutes, thereby to dissolve out the soluble copolymer. After being washed with water and air dried, the fabric was heat-set at a temperature of 165° C., for three minutes under dry heat conditions without any substantial tension applied thereto. The resultant fabric highly resembled silk in aesthetic quality and exhibited good drape, bulkiness and a soft hand.

EXAMPLE 4

Poly-epsilon-capramide (nylon 6) having a viscosity of 2.4, as measured in sulfuric acid and an ethylene terephthalate (95% by mole)/ethylene 5-sodium-sulfoisophthalate (5% by mole) copolymer having an intrinsic viscosity of 0.53 were melt-spun, by using a composite spinning apparatus similar to that used in Example 1, at a temperature of 263° C. and a spinning rate of 1,200 meters/minute, to obtain a bundle of 36 composite filaments having a transverse cross-section similar to that shown in FIG. 1*e*. The soluble copolymer occupied 15% by weight of the composite filaments. The bundle of the 36 filaments was drawn in a conventional manner by using a heated pin of 100° C. at a drawing speed of 400 meters/minute and at a drawing ratio of 3.4, thereby to obtain a filament yarn comprised of 36 filaments and having a total fineness of 82 deniers (this filament was, after alkali-treatment, divided into 108 filaments having a total fineness of 70 deniers).

The separation resistance of the filament yarn was 2,310 times (fluff formation) and 3,560 times (yarn break). When the filament yarn was treated with an aqueous sodium hydroxide solution of 30 grams/liter concentration at a temperature of 100° C., the soluble copolymer was completely dissolved out in three minutes.

The filament yarn was woven into a plain fabric (taffeta) with a warp density of 116/2.54 centimeters and a weft density of 93/2.54 centimeters. During the weaving process, warp break was observed only 0.6 time per yarn length of 1,000,000 meters. Fluff formation was negligible. The plain fabric was scoured in an aqueous bath containing Noigen and soda lime at a temperature of 98° to 100° C., and then, heat-set at a temperature of 120° C., for five minutes, under wet heat conditions such that free shrinkage of the fabric was permitted. Thereafter, the plain fabric was treated with an aqueous solution containing sodium hydroxide at a concentration of 30 gram/liter, at a temperature of 100° C. for a period of five minutes, thereby to dissolve out the soluble copolymer. After being washed with water and air dried, the fabric was heat-set at a temperature of 150° C., for five minutes, under dry heat conditions without any substantial tension applied thereto. The resultant fabric exhibited good drape, bulkiness and a soft hand.

COMPARATIVE EXAMPLE 1

Following a procedure similar to that mentioned in Example 4, composite filaments were prepared, and further, a plain woven fabric was woven therefrom. However, in this comparative example, an ethylene terephthalate (98.0% by mole)/ethylene 5-sodium-sulfoisophthalate (2.0% by mole) copolymer was used as the soluble polymer component.

The separation resistance of the drawn filament yarn was 270 times (fluff formation) and 930 times (yarn break). When the filament yarn was treated with an aqueous sodium hydroxide solution of 30 grams/liter concentration at a temperature of 100° C., 100 minutes were needed for the complete dissolution of the soluble copolymer. During the weaving process, warp break was observed 2.7 times per yarn length of 1,000,000 meters. Fluff formation was conspicuous. When the plain woven fabric was treated with an aqueous sodium hydroxide solution of 30 grams/liter concentration at a temperature of 100° C., 120 minutes were needed for the complete dissolution of the soluble copolymer.

What we claim is:

1. A separable unitary composite fiber having a substantially uniformly shaped transverse cross-section along its length, said composite fiber being comprised of at least two different polymer components, one of which is soluble in a given solvent and the other of which is relatively insoluble in the given solvent, a plurality of segments of said relatively insoluble polymer component being isolated from each other by the intervening soluble polymer component in the transverse cross-section of the composite fiber, said soluble polymer component being a polyester comprised of 80 to 97% by mole of ethylene terephthalate units and 3 to 20% by mole of ethylene 5-sodium-sulfoisophthalate units, and said relatively insoluble polymer component being a fiber-forming polymer selected from the group consisting of polyester and polyamide.

2. A composite fiber according to claim 1 wherein said relatively insoluble polymer component is a polyester.

3. A composite fiber according to claim 2 wherein said polyester comprises at least 80% by mole of ethylene terephthalate units.

4. A composite fiber according to claim 1 wherein said relatively insoluble polymer component is a polyamide.

5. A composite fiber according to any one of claims 1 to 4 wherein said segments of the relatively insoluble polymer component have an average fineness of not greater than one denier per segment.

6. A method of producing a separable unitary composite fiber having a substantially uniformly shaped transverse cross-section along its length, which method comprises spinning at least two different polymers, one of which is a copolyester comprised of 80 to 97% by mole of ethylene terephthalate units and 3 to 20% by mole of ethylene 5-sodium-sulfoisophthalate units and the other of which is a fiber-forming polymer selected from the group consisting of polyester and polyamide, to form a composite fiber having a transverse cross-section such that a plurality of segments of the fiber-forming polymer are isolated from each other by the intervening ethylene terephthalate/ethylene 5-sodium-sulfoisophthalate copolyester.

7. A method according to claim 6 wherein said fiber-forming polymer is a polyester.

8. A method according to claim 7 wherein said ethylene terephthalate/ethylene 5-sodium-sulfoisophthalate copolyester has an intrinsic viscosity of not greater than 0.60 as determined in orthochlorophenol at a temperature of 25° C., and said polyester comprises at least 80% by mole of ethylene terephthalate units.

9. A method according to claim 6 wherein said fiber-forming polymer is a polyamide.

10. A method according to any one of claims 6 to 9 wherein said segments of the fiber-forming polymer have an average fineness of not greater than one denier per segment.

11. A fabric made of a separable unitary composite fiber as defined in claim 1.

12. A fabric obtained by treating the fabric defined in claim 11 with an aqueous alkaline solution, thereby to dissolve out at least part of the ethylene terephthalate/ethylene 5-sodium-sulfoisophthalate copolyester from the composite fiber.

* * * * *